US006203235B1

(12) United States Patent
Bonde

(10) Patent No.: US 6,203,235 B1
(45) Date of Patent: Mar. 20, 2001

(54) METHOD AND APPARATUS FOR SECURING A CRATE FASTENER TO A CRATE PANEL

(75) Inventor: James R. Bonde, Glen Ellyn, IL (US)

(73) Assignee: Klimp Industries, Inc., Addison, IL (US)

( * ) Notice: Subject to any disclaimer, the term of this patent is extended or adjusted under 35 U.S.C. 154(b) by 0 days.

(21) Appl. No.: 09/183,133

(22) Filed: Oct. 30, 1998

(51) Int. Cl.[7] ..... B65D 8/10

(52) U.S. Cl. ..... 403/321; 403/231; 16/384; 24/350; 217/65

(58) Field of Search ..... 403/321, 323, 403/402, 231, 338; 16/384, 382, 342; 24/350, 347, 380, 377; 217/57, 61, 24, 65

(56) References Cited

U.S. PATENT DOCUMENTS

| | | | | |
|---|---|---|---|---|
| 479,797 | * | 8/1892 | Garbrance | 217/24 X |
| 942,391 | * | 12/1909 | Kinsey | 16/384 X |
| 3,082,897 | | 3/1963 | Highley | 217/65 |
| 3,154,828 | * | 11/1964 | Bonde | 217/65 |
| 3,323,674 | * | 6/1967 | Nist, Jr. | 217/65 X |
| 3,921,846 | * | 11/1975 | Mellott et al. | 217/65 |
| 3,990,599 | * | 11/1976 | Rowley | 217/65 X |
| 4,062,087 | * | 12/1977 | Lingle | 24/347 X |
| 4,139,113 | * | 2/1979 | Graham, Jr. | 217/65 X |
| 4,453,471 | * | 6/1984 | Harrington et al. | 217/65 X |
| 4,454,636 | * | 6/1984 | Pearson | 24/347 |
| 4,796,392 | * | 1/1989 | Graham, Jr. | 217/61 X |
| 4,935,998 | * | 6/1990 | Frazier et al. | 24/350 |
| 5,542,775 | * | 8/1996 | Bechtoldt et al. | 24/350 X |

* cited by examiner

*Primary Examiner*—Lynne H. Browne
*Assistant Examiner*—David E. Bochna
(74) *Attorney, Agent, or Firm*—McAndrews, Held & Malloy, Ltd.

(57) ABSTRACT

A crate fastener and retainer assembly includes a fastener for assembling two adjacent panels of a box or crate, and a retainer for securing the fastener to a panel. L-shaped fasteners assemble two adjacent cleated panels or slotted panels, and retainers mounted on the panel or cleat secure the fasteners to the panel. The retainer includes a plate with a substantially closed loop on one end. The other end of the plate is mounted to the cleat or the panel. The substantially closed loop of the plate is pivotally connected to an end of the L-shaped fastener. When the box or crate is disassembled, the L-shaped fastener remains secured to one of the panels.

3 Claims, 2 Drawing Sheets

METHOD AND APPARATUS FOR SECURING A CRATE FASTENER TO A CRATE PANEL

CROSS-REFERENCE TO RELATED APPLICATIONS

Not Applicable

STATE REGARDING FEDERALLY SPONSORED RESEARCH OR DEVELOPMENT

Not Applicable

BACKGROUND OF THE INVENTION

The present invention relates generally to fasteners for assembling two adjacent panels of a box or crate, and retainers for securing the fasteners to the panel. More specifically, the present invention relates to L-shaped fasteners for assembling two adjacent cleated panels or slotted panels, and retainers mounted on the panel or cleat for securing the fasteners to the panel.

The term "box" and the term "crate" will be used interchangeably throughout this document to encompass any structure with at least two panels assembled together. Many types of fasteners can be used to assemble the box or crate. The boxes and crates are also disassembled for more compact storage when they are not being used. Some types of fasteners, such as nails and staples, are damaged during disassembly and are, thus, not reusable for a later assembly. Other types of fasteners, such as those illustrated in U.S. Pat. No. 3,082,897 and U.S. Pat. No. 3,154,828 do not sustain damage during disassembly and are, thus, reusable for a later assembly. These reusable fasteners are generally L-shaped with tabs on each end.

The panels of the boxes or crates have either slots milled into the panels or a surrounding frame of four cleats around the peripheral edge of the panels. Two adjacent panels are assembled with the reusable fasteners by hooking one tab of the fastener over the edge of a cleat, or into a milled slot, of one panel, and spanning the joint between the adjacent panels by hooking the other tab over the edge of a cleat, or into a milled slot, of the other panel. The reusable fasteners are locked into place by the action of the two tabs against either the cleats or the inside of the slots. Multiple fasteners are used along the joint between the adjacent panels. When the boxes or crates are disassembled, the reusable fasteners are physically separated from the box or crate. This leads to problems such as misplacing or losing the fasteners, and exposing the fasteners to damage from objects larger than the fasteners. Since the reusable fasteners may be needed to assemble a box or crate at a later time, there is a need to prevent misplacement, loss, and damage of the fasteners.

SUMMARY OF THE INVENTION

Accordingly, an object of the invention is to provide a reusable fastener that is prevented from becoming misplaced, lost, or damaged between panel disassembly and panel assembly.

This and other objects and advantages are provided in a fastener assembly for fastening together two adjacent cleated panels of a crate which is improved over prior devices in that a retainer secures the crate fastener to the cleated crate panel. In a first cleated embodiment, the retainer has a plate with one end mounted between the cleat and the panel, and the other end forming a loop adjacent to the interior edge of the cleat for pivotally connecting the crate fastener to the retainer.

In a second cleated embodiment, the retainer has a plate with one end mounted on the bottom surface of the cleat, and the other end forming a loop adjacent to the interior edge of the cleat for pivotally connecting the crate fastener to the retainer. For example, the panel may not be continuous, but instead may have gaps. In this case, the retainer may be mounted at a point on the cleat adjacent to a panel gap by mounting the retainer on the bottom of the cleat instead of between the cleat and the panel.

An improved fastener assembly for fastening together two adjacent slotted panels of a crate has a retainer for securing the crate fastener to the slotted crate panel. The retainer has a plate with one end mounted on the interior surface of the panel, and the other end forming a loop aligned with the panel slot for pivotally connecting the crate fastener to the retainer.

In addition, this and other objects and advantages are provided in a method of securing a crate fastener to a cleated crate panel which is improved over prior art methods in that the method performs the steps of forming a loop at one end of a plate, mounting the other end of the plate between a cleat and the panel such that the loop is adjacent to the interior edge of the cleat, and pivotally connecting the crate fastener to the loop.

In another aspect of the invention, the method secures a crate fastener to a cleated crate panel with gaps in the panel. The method is improved over prior art methods in that the method performs the steps of forming a loop at one end of a plate, mounting the other end of the plate on the bottom surface of the cleat such that the loop is adjacent to the interior edge of the cleat, and pivotally connecting the crate fastener to the loop.

In a further aspect of the invention, the improved method secures a crate fastener to a slotted crate panel. The method is improved over prior art methods in that the method performs the steps of forming a loop at one end of a plate, mounting the other end of the plate on the interior surface of the panel such that the loop is aligned with a panel slot, and pivotally connecting the crate fastener to the loop.

DETAILED DESCRIPTION OF THE PREFERRED EMBODIMENTS

Figure 1:
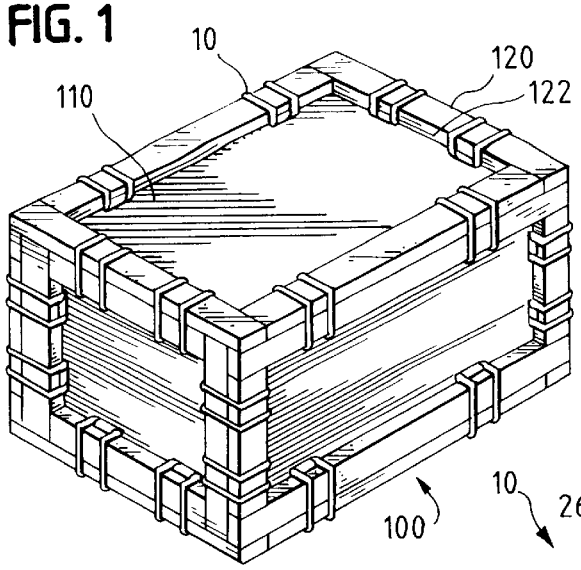
FIG. 1 is a perspective view of a fastener assembly according to the present invention, showing a cleated crate assembled using the fastener assembly.

FIG. 1 is a perspective view of a fastener assembly according to the present invention, showing a cleated crate assembled using the fastener assembly. The fastener assembly 10 is more clearly illustrated in FIG. 2 which shows a perspective view of the fastener assembly of FIG. 1, enlarged to show in greater detail the fastener and retainer, and showing in dotted lines the position of the retainer as it is connected to the fastener in accordance with the present invention. The fastener 20 is an L-shaped fastener of the type illustrated in U.S. Pat. No. 3,082,897 and U.S. Pat. No. 3,154,828. The fastener 20 is made of spring wire and has two legs, a first leg 22 and a second leg 24, that define the L-shape. The first leg 22 has a first tab 26 at an end of the first leg 22 farthest from the second leg 24. The second leg 24 has a second tab 28 at an end of the second leg 24 farthest from the first leg 22. The tabs 26 and 28 are substantially perpendicular to their respective legs 22 and 24 and extend inwardly, projecting in the general direction of the farthest legs 24 and 22, respectively. The tabs 26 and 28 form a first loop 30 and a second loop 32, respectively. The loops 30 and 32 lie in a plane that is substantially perpendicular to the axes of the respective legs 22 and 24. The axes of the loops 30 and 32 are perpendicular to the axes of the respective tabs 26 and 28.

Figure 2:
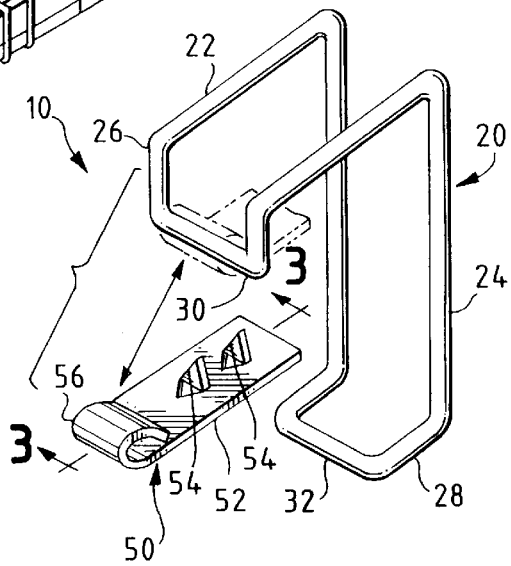
FIG. 2 is a perspective view of the fastener assembly of FIG. 1, enlarged to show in greater detail the fastener and retainer, and showing in dotted lines the position of the retainer as it is connected to the fastener in accordance with the present invention.

The fastener 20 illustrated in FIG. 2 and described above is known in the art. In accordance with the present invention, the improvement to the fastener 20 comprises a retainer 50. In a preferred embodiment, the retainer 50 comprises a metal plate 52. One end of the plate 52 has projections 54 substantially perpendicular to the plate 52. The projections 54 are cut out of the plate 52 such that the projections 54 are pointed. The other end of the plate 52 forms a substantially closed loop 56. The retainer 50 is connected to the fastener 20 by forming the substantially closed loop 56 of the retainer 50 around the loop 30 of the fastener 20. In an alternative embodiment, the substantially closed loop 56 of the retainer 50 is formed around loop 32 of the fastener 20.

Figure 3:
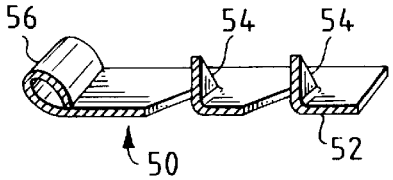
FIG. 3 is a cut-away perspective view of the retainer of FIG. 2.

FIG. 3 is a cut-away perspective view of the retainer 50 illustrating the plate 52, the projections 54, and the substantially closed loop 56.

Figure 4:
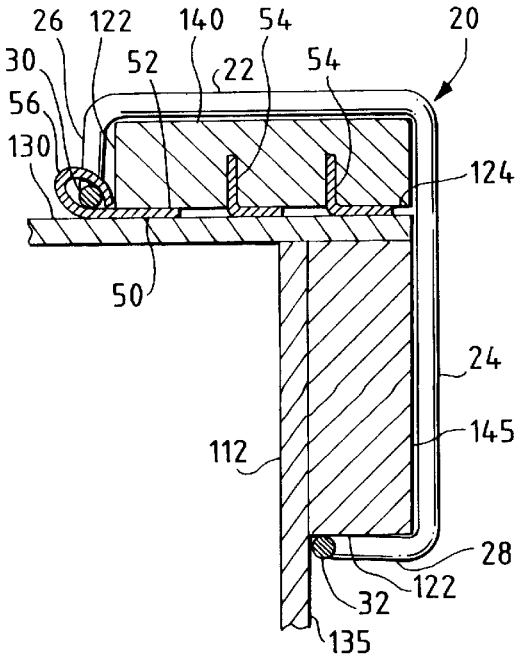
FIG. 4 is a sectional view showing the fastener assembly mounted between the cleat and the panel of the cleated crate and applied to the cleats of two adjacent panels.
Figure 5:
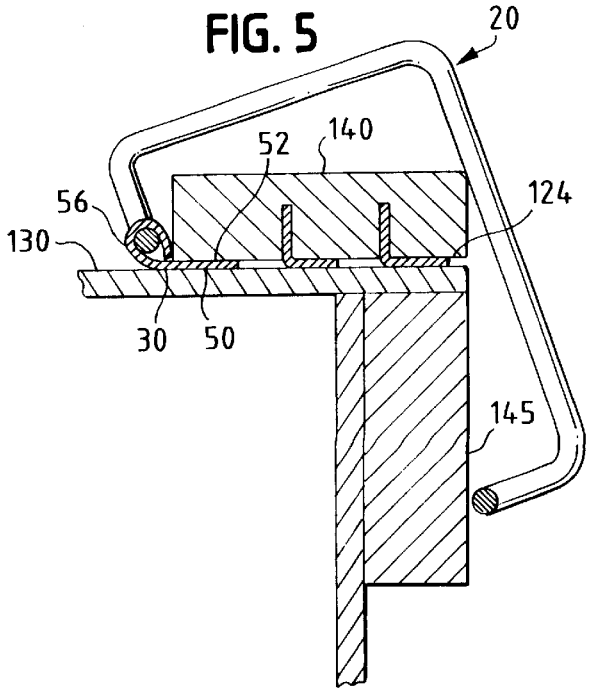
FIG. 5 is the sectional view of the fastener assembly of FIG. 4 showing the position of the fastener assembly as it is being removed from the cleats of two adjacent panels of the cleated crate.

FIG. 1 shows the fastener assembly 10 applied to the cleated crate 100. Each side of the cleated crate 100 is formed of a panel 110. The panel 110 has a cleat 120 on each marginal edge of the panel 110. Thus, each panel 110 has four cleats 120. The cleat 120 has an interior edge 122 facing the interior portion of the panel 110. The cleat 120 also has a bottom surface 124 as illustrated in FIGS. 4 and 5. The bottom surface 124 is the surface closest to the panel 110. The panels 110 are assembled by mounting the fastener assembly 10 between the cleat 120 and the panel 110 and then applying the fastener assembly 10 to the cleats 120 of two adjacent panels 110. This is more clearly shown in FIGS. 4 and 5.

FIG. 4 is a sectional view showing the fastener assembly mounted between the cleat and the panel of the cleated crate and applied to the cleats of two adjacent panels. A portion of the cleated crate 100 in FIG. 1 is illustrated with two adjacent panels depicted by a first panel 130 and a second panel 135. The first panel 130 has a cleat 140 and the second panel 135 has a cleat 145.

In a preferred embodiment, the retainer 50 is pivotally connected to the fastener 20 by forming the substantially closed loop 56 at one end of the plate 52 around the loop 30 of the fastener 20. The other end of the plate 52 is mounted between the first panel 130 and the cleat 140 of the first panel 130. The projections 54 extend into the cleat 140. After mounting the plate 52, the substantially closed loop 56 is adjacent to the interior edge 122 of the cleat 140. Adjacent may or may not imply contact. Thus, the substantially closed loop 56 may come in contact with the interior edge 122 of the cleat 140, or the substantially closed loop 56 may be spaced apart from the interior edge 122 of the cleat 140. In the latter case, the first leg 22 of the fastener 20 must be long enough to accommodate the additional spacing between the substantially closed loop 56 and the interior edge 122 of the cleat 140.

In an alternative embodiment, the projections 54 extend into the first panel 130 instead of extending into the cleat 140. In another embodiment, the plate 52 need not be formed of a solid piece of metal. For example, the plate 52 might be forked on each end, or there might be a segment cut out of the middle of the plate 52. Many variations are possible as long as the plate 52 has one end forming a substantially closed loop 56 and the other end mountable between the first panel 130 and the cleat 140. In a further embodiment, the retainer 50 is pivotally connected to the fastener 20 by forming the substantially closed loop 56 at one end of the plate 52 around the loop 32 of the fastener 20. The other end of the plate 52 is mounted between the second panel 135 and the cleat 145 of the second panel 135 such that the substantially closed loop 56 is adjacent to the interior edge 122 of the cleat 145.

In operation, the fastener 20 is applied to the cleat 140 of the first panel 130 and the cleat 145 of the second panel 135 by extending the first tab 26 along the interior edge 122 of the cleat 140. The first leg 22 is then extended along the width of the cleat 140. The second leg 24 is extended along the height of the cleat 140, the height of the plate 52, the height of the panel 130, and the width of the cleat 145. Finally, the second tab 28 is extended along the interior edge 122 of the cleat 145.

FIG. 5 is the sectional view of the fastener assembly of FIG. 4 showing the position of the fastener assembly as it is being removed from the cleats of two adjacent panels of the cleated crate. In operation, once the fastener 20 is disengaged from the cleats 140 and 145, the fastener 20 is free to move and would be physically separate and independent from the panel 130 if not for the pivotal connection of the substantially closed loop 56 of the retainer 50 to the loop 30 of the fastener 20. Thus, it is seen that the present fastener assembly overcomes the drawbacks of the prior art fastener 20 by mounting the retainer 50 between the panel 130 and the cleat 140 and then pivotally connecting the fastener 20 to the retainer 50. As a result, the disengaged fastener 20 is no longer physically separated from the panel 130. This will prevent loss, misplacement, or damage of the fastener 20.

Figure 6:
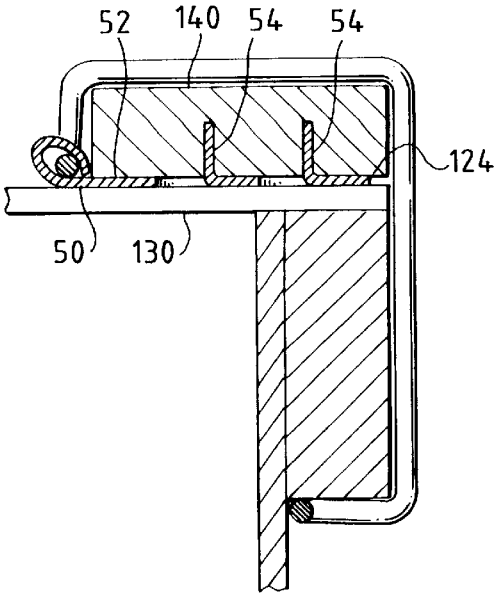
FIG. 6 is a sectional view of the fastener assembly of FIG. 4 showing the fastener assembly mounted to the bottom surface of the cleat of the crate and applied to the cleats of two adjacent panels.

FIG. 6 is a sectional view of the fastener assembly of FIG. 4 showing the fastener assembly mounted to the bottom surface of the cleat of the crate and applied to the cleats of two adjacent panels. This is an alternative embodiment for mounting the plate 52 of the retainer 50 when the panel 130 is not continuous, but instead has a gap. The gap may occur adjacent to the cleat 140 in which case the plate 52 of the retainer 50 must be mounted on the bottom surface 124 of the cleat 140 with the projections 54 extending into the cleat 140.

Figure 7:
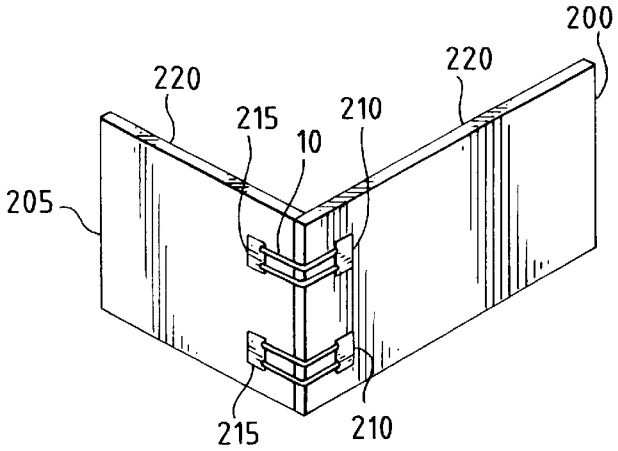
FIG. 7 is a perspective view of the improved fastener assembly showing two adjacent panels of a slotted crate assembled using the fastener assembly.

FIG. 7 is a perspective view of the improved fastener assembly showing two adjacent panels of a slotted crate assembled using the fastener assembly. A first panel 200 and a second panel 205 have slots 210 and 215, respectively. In addition, the first panel 200 and the second panel 205 each have an interior surface 220. The first panel 200 and the second panel 205 are assembled by mounting the fastener assembly 10 on the interior surface 220 of the first panel 200 and then applying the fastener assembly 10 to the first panel 200 and the second panel 205. This is more clearly shown in FIG. 8.

Figure 8:
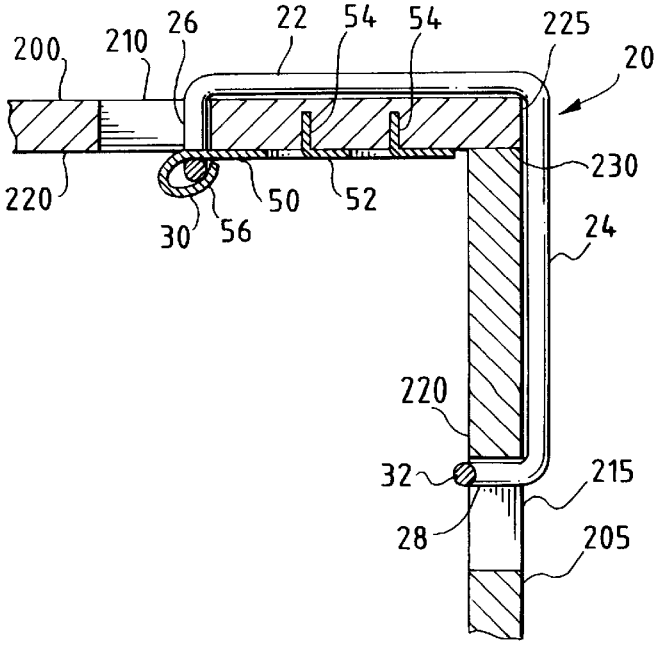
FIG. 8 is a sectional view of the fastener assembly mounted on the interior surface of the panel of the slotted crate and applied to two adjacent panels.

FIG. 8 is a sectional view of the fastener assembly mounted on the interior surface of the panel of the slotted crate and applied to two adjacent panels. In a preferred embodiment, the retainer 50 is pivotally connected to the fastener 20 by forming the substantially closed loop 56 at one end of the plate 52 around the loop 30 of the fastener 20. The other end of the plate 52 is mounted on the interior surface 220 of the first panel 200. After mounting the plate 52, the substantially closed loop 56 is aligned with the panel slot 210 of the first panel 200. The projections 54 extend into the first panel 200. The plate 52 may be mounted anywhere on the interior surface 220 of the first panel 200, as for example, on the opposite side of the slot 210, as long as the substantially closed loop 56 is aligned with the panel slot 210.

In an alternative embodiment, the plate 52 need not be formed of a solid piece of metal. For example, the plate 52 might be forked on each end, or there might be a segment cut out of the middle of the plate 52. Many variations are possible as long as the plate 52 has one end forming a substantially closed loop 56 and the other end mountable on the interior surface 220 of the first panel 200. In another embodiment, the retainer 50 is pivotally connected to the fastener 20 by forming the substantially closed loop 56 at one end of the plate 52 around the loop 32 of the fastener 20. The other end of the plate 52 is mounted on the interior surface 220 of the second panel 205. After mounting the plate 52, the substantially closed loop 56 is aligned with the panel slot 215 of the second panel 205.

In operation, the fastener 20 is applied to the first panel 200 and the second panel 205 by extending the first tab 26 into the slot 210 of the first panel 200. The first leg 22 is then extended along the distance between the slot 210 and the end 225 of the first panel 200. The second leg 24 is extended along the height of the first panel 200 and the distance between the end 230 of the second panel 205 and the slot 215 of the second panel 205. Finally, the second tab 28 is extended into the slot 215 of the second panel 205.

Once the fastener 20 is disengaged from the first panel 200 and the second panel 205, the fastener 20 is free to move and would be physically separate and independent from the first panel 200 if not for the pivotal connection of the substantially closed loop 56 of the retainer 50 to the loop 30 of the fastener 20. Preferably the panel slots 210 and 215 are at least as wide as the lengths of the first tab 26 and the second tab 28, respectively, to provide clearance for the tabs 26 and 28 when the fastener 20 is disengaged. Thus, it is seen that the present fastener assembly overcomes the drawbacks of the prior art fastener 20 by mounting the retainer 50 on the interior surface of the first panel 200 and then pivotally connecting the fastener 20 to the retainer 50. As a result, the disengaged fastener 20 is no longer physically separated from the first panel 200. This will prevent loss, misplacement, or damage of the fastener 20.

While the invention has been described in connection with one or more embodiments, it will be understood that the invention is not limited to those embodiments. On the contrary, the invention includes all alternatives, modifications, and equivalents as may be included within the spirit and scope of the appended claims.

What is claimed is:

1. A fastener assembly for fastening together two adjacent cleated panels of a crate, said fastener assembly comprising:

a substantially L-shaped fastener having two legs, a first leg extendable along at least the width of a cleat of the first panel, and a second leg extendable along at least the height of the cleat of the first panel and the width of a cleat of the second panel, said first leg having a first tab substantially perpendicular to said first leg and extendable along the interior edge of the cleat of the first panel at an end of said first leg farthest from said second leg, said second leg having a second tab substantially perpendicular to said second leg and extendable along the interior edge of the cleat of the second panel at an end of said second leg farthest from said first leg, at least one of said first and second tabs forming a loop in a plane that is substantially perpendicular to the axis of the respective leg of said at least one looped tab; and a retainer comprising a plate having two ends, one end of said plate fixedly mountable between the cleat and the panel nearest to one of said at least one looped tab, the other end of said plate extending from between the cleat and the panel to form a substantially closed loop adjacent to the interior edge of the cleat for pivotally connecting said one of said at least one looped tab.

2. A fastener assembly for fastening together two adjacent cleated panels of a crate, said fastener assembly comprising:

a substantially L-shaped fastener having two legs, a first leg extendable along at least the width of a cleat of the first panel, and a second leg extendable along at least the height of the cleat of the first panel and the width of a cleat of the second panel, said first leg having a first tab substantially perpendicular to said first leg and extendable along the interior edge of the cleat of the first panel at an end of said first leg farthest from said second leg, said second leg having a second tab substantially perpendicular to said second leg and extendable along the interior edge of the cleat of the second panel at an end of said second leg farthest from said first leg, at least one of said first and second tabs forming a loop in a plane that is substantially perpendicular to the axis of the respective leg of said at least one looped tab; and a retainer comprising a plate having two ends, one end of said plate fixedly mountable on the bottom surface of the cleat nearest to one of said at least one looped tab, the other end of said plate forming a substantially closed loop adjacent to the interior edge of the cleat for pivotally connecting said one of said at least one looped tab.

3. A fastener assembly for fastening together two adjacent slotted panels of a crate, said fastener assembly comprising:

a substantially L-shaped fastener having two legs, a first leg extendable along at least the distance between a slot of the first panel and an end of the first panel, and a second leg extendable along at least the height of the first panel and the distance between an end of the second panel adjacent to the end of the first panel and a slot of the second panel, said first leg having a first tab substantially perpendicular to said first leg and extending into the slot of the first panel at an end of said first leg farthest from said second leg, said second leg having a second tab substantially perpendicular to said second leg and extending into the slot of the second panel at an end of said second leg farthest from said first leg, at least one of said first and second tabs forming a loop in a plane that is substantially perpendicular to the axis of the respective leg of said at least one looped tab; and a retainer comprising a plate having two ends, one end of said plate fixedly mountable on the interior surface of the panel nearest to one of said at least one looped tab, the other end of said plate forming a substantially closed loop aligned with the panel slot for pivotally connecting said one of said at least one looped tab.

* * * * *